US011548049B2

(12) United States Patent
Maier et al.

(10) Patent No.: US 11,548,049 B2
(45) Date of Patent: Jan. 10, 2023

(54) SHEET METAL BENDING MACHINE WITH VARIABLE ROLLER GEOMETRY

(71) Applicant: HAEUSLER AG Duggingen, Duggingen (CH)

(72) Inventors: Mario Maier, Bernau im Schwarzwald (DE); Benjamin Schauble, Lorrach (DE); Florian Bittner, Mumpf (CH)

(73) Assignee: HAEUSLER AG Duggingen

( * ) Notice: Subject to any disclaimer, the term of this patent is extended or adjusted under 35 U.S.C. 154(b) by 224 days.

(21) Appl. No.: 16/439,525

(22) Filed: Jun. 12, 2019

(65) Prior Publication Data

US 2019/0374989 A1 Dec. 12, 2019

(30) Foreign Application Priority Data

Jun. 12, 2018 (DE) ..... 10 2018 113 966.7

(51) Int. Cl.
*B21D 5/00* (2006.01)
*B21D 5/08* (2006.01)
*B21D 11/08* (2006.01)

(52) U.S. Cl.
CPC ..... *B21D 5/08* (2013.01); *B21D 11/08* (2013.01)

(58) Field of Classification Search
CPC ..... B21D 5/06; B21D 5/08; B21D 5/14; B21D 11/203; B21D 11/08; B21D 5/083; B21D 11/20
USPC ..... 72/170, 173, 176, 406
See application file for complete search history.

(56) References Cited

U.S. PATENT DOCUMENTS 1,949,401 A * 3/1934 Baldwin ..... B21D 53/886 72/173
3,309,908 A * 3/1967 Coffin, Jr. ..... B21D 1/05 72/213
5,187,959 A * 2/1993 Davi ..... B21D 5/14 72/10.6
5,361,618 A * 11/1994 Stefanelli ..... B21C 47/08 72/146
6,044,675 A * 4/2000 Davi ..... B21D 5/14 72/173
2010/0089114 A1* 4/2010 Boldrini ..... B21D 5/14 72/249

FOREIGN PATENT DOCUMENTS

CH 269241 A 6/1950
DE 3615771 A1 11/1987

* cited by examiner

*Primary Examiner* — Debra M Sullivan
(74) *Attorney, Agent, or Firm* — Workman Nydegger

(57) ABSTRACT

A bending machine is described, which comprises an upper roller and a lower roller, as well as at least one side roller. The side roller is held in a rocker arm, wherein the first end of which is fixed to a movable supporting member, and the second end of which can be supported in a first position relative to the upper and lower rollers. The rocker arm can be moved to a second position by means of the movable supporting member and fixed there with the second end.

10 Claims, 9 Drawing Sheets

SHEET METAL BENDING MACHINE WITH VARIABLE ROLLER GEOMETRY

CROSS-REFERENCE TO RELATED APPLICATIONS

The present invention claims the benefit of priority to German Patent Application No. 102018113966.7 filed Jun. 12, 2018. The entire contents of the foregoing patent application is incorporated by reference herein.

BACKGROUND OF THE INVENTION

1. The Field of the Invention

This invention relates to a bending machine with a variable roller or shaft geometry, particularly a roller sheet metal bending machine with at least three rollers.

2. Background and Relevant Art

The invention relates to a bending machine, particularly a round bending machine, according to the preamble of claim 1.

The bending of large sheet metals into molding parts is typically carried out with sheet metal bending machines, to which a sheet metal is supplied from one side, and which brings the sheet metal as exactly as possible into the desired shape by applying a force. The degree of deformation is determined both, by the applied force, and by the parameters of the sheet metal.

Typically, but not necessarily, the temperature of a supplied sheet metal is essentially the ambient temperature, i.e., the sheet bending process is cold molding. Even if the following embodiments of the invention are based on thus a cold sheet metal, the described method and the corresponding control system should not be limited to this. The described method can also be used for heated or hot sheet metal.

From the prior art, various presses are known for bending sheet metal, for example, press brakes, as well as embossing machines and so-called round bending machines, and are used for forming sheet metal into cylindrical or conical tubes, or corresponding tube segments.

The round bending machines described here work according to the known round-rolling method, and have at least three rollers. The sheet metal to be bent can be clamped between two rollers, an upper roller and a lower roller, one of which is motor-driven, so that a clamped sheet between these rollers can be moved by rotating the rollers. To bend the sheet metal, a bending force is applied to the sheet metal by another roller, a side roller. Depending on the geometrical arrangement of the rollers and the properties of the sheet metal, the sheet metal can be moved between the rollers of the bending machine and over the side roller, using at least one driven roller, so that the sheet metal is bent.

In an alternative embodiment, the machine can only comprise the upper roller and a first and second side roller. A sheet to be bent is then guided through the first side roller, which can also be called the auxiliary roller, below the upper roller and then over the second side roller, wherein the second side roller is positioned so that the sheet metal is bent. The propulsion of the sheet metal can be designed as needed. The invention described below is independent of whether the bending machine comprises an upper and/or lower roller of the machine. It can be used both, in a bending machine comprising an upper and lower roller, or in a machine comprising either one upper or lower roller.

BRIEF SUMMARY OF THE INVENTION

Without limiting the generality, the invention is described below, based on an embodiment of a bending machine comprising an upper and a lower roller.

The degree of deformation during a bending process depends on the plurality of parameters. First, the properties of the sheet metal to be bent, such as sheet metal thickness, deformability, and viscosity, have a significant influence on the radius of the bent sheet metal. Second, the geometry of the rollers, including the geometric dimensions of the rollers arranged in the bending direction determine even the smallest possible bending radius during the bending process. The theoretically smallest possible bending radius is typically the diameter of the upper roller or the roller around whose radius the sheet metal is bent. In order to achieve this, the sheet to be bent must be positioned in such a way that it is guided as closely as possible to the corresponding roller, for example, when the sheet is bent around the radius of the upper roller. Consequently, the geometry of the rollers must be adapted to each other according to the desired bending radius and the thickness of the sheet metal.

The geometry of the rollers on such a bending machine, particularly the relative arrangement of the rollers in relation to each other, is determined by the holder of the rollers. In conventional roller arrangements, a side roller can be held by a rocker arm, one end fixed in the girder of a bending machine, and the other end supported by a hydraulic cylinder. The position of the rocker arm and thus the position of the side roller held by it can be changed using the position of the hydraulic cylinder. Instead of a hydraulic cylinder, another actuator, for example, a threaded rod can be used. Such rolling machines have the disadvantage, however, that the movable side roller can only be moved within strict limits since one end of the rocker arm is fixed. Replacing the side roller, or changing the position of the fixed rocker arm, requires considerable effort.

This problem is solved by a bending machine, according to claim 1; preferable designs are indicated in the dependent claims.

BRIEF DESCRIPTION OF THE DRAWINGS

The following is a description of such a bending machine based on the figures, in which.

DETAILED DESCRIPTION OF THE PREFERRED EMBODIMENTS

The figures show a bending machine or parts of it in a schematic representation. Therefore, the figures are not fully scaled, nor do they show all the details of a typical bending machine. Particularly, only the fundamental machine members are shown for illustration purposes.

Figure 1:
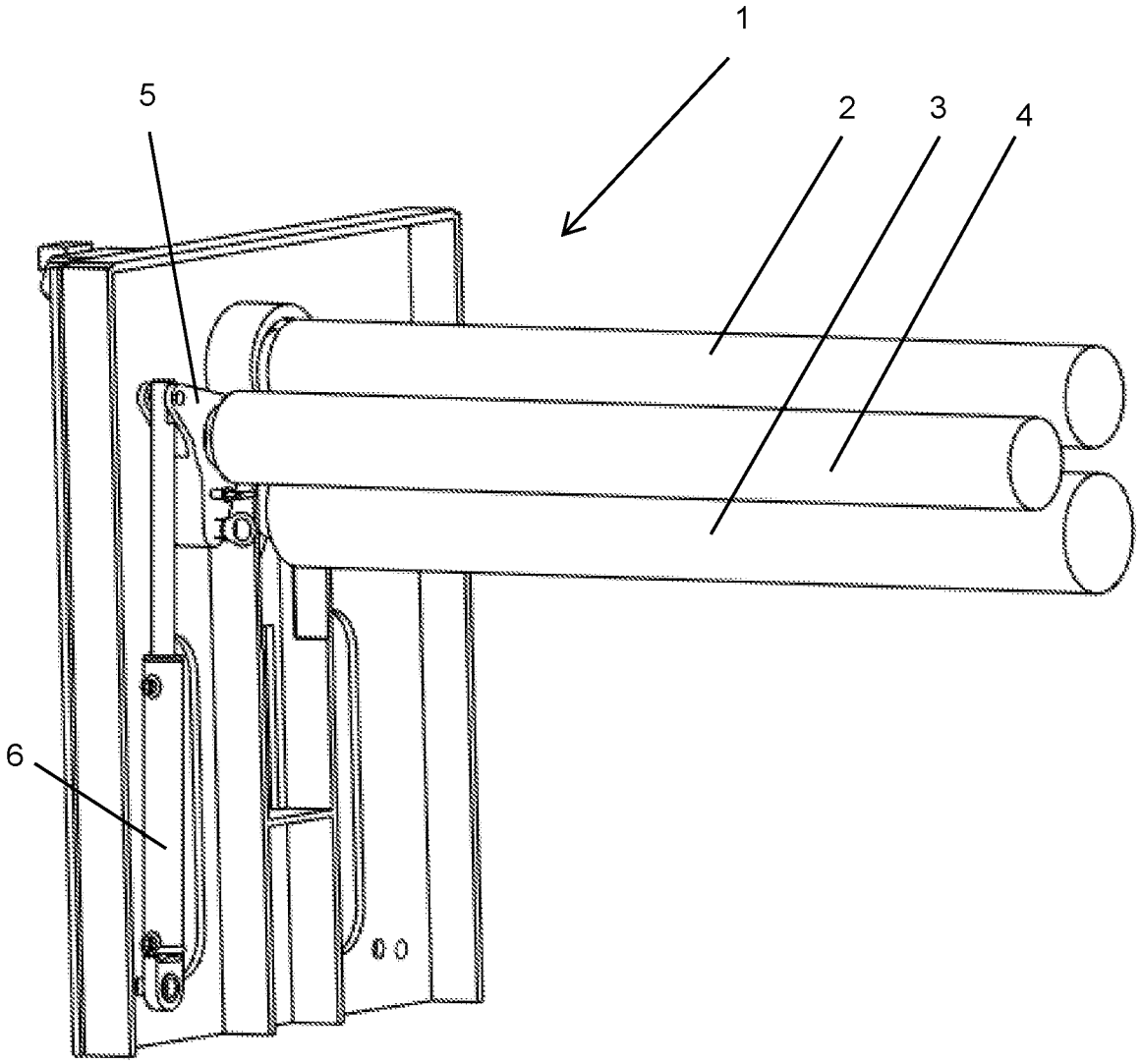
FIG. 1 shows a perspective, schematic view of a bending machine with at least 3 rollers.

FIG. 1 shows a perspective view of a bending machine (1) with an upper roller (2), a lower roller (3) and a side roller (4). Typically, at least the upper roller (2) or the lower roller (3) is motor driven, so that the sheet to be bent (not drawn in the figure), which is clamped between the upper and lower rollers, can be moved by the upper and lower rollers respectively in the direction of at least one side roller (4). In this way, a sheet metal clamped between the upper and lower rollers can be moved in the direction of the side roller (4) and guided over the side roller (4), wherein the sheet metal is bent depending on the geometric arrangement of the side roller. Therefore regarding FIG. 1, it should be noted that only one suspension side of the rollers is shown in the illustration; in fact, the rollers are appropriately held at both ends.

The bending machine is typically set up so that the distance between the upper and lower rollers is variable in order to adapt the distance between these two rollers to the thickness of the sheet, i.e., at least one roller can be moved, so that the sheet metal can be clamped between these two rollers and moved by rotating the rollers.

The three points necessary for bending the sheet metal are realized in the embodiment described here, by the upper and lower roller (2, 3), and the side roller. The bending lever adjusts itself when the side roller (4) is adjusted, depending on the lower roller pressure set between the upper and lower rollers. In the alternative embodiment mentioned above, the three necessary points for bending are realized with the first and second side roller and the upper roller.

The side roller (4) is held by least one of its two ends of the rocker arm (5). This holder of the side roller (4) in the rocker arm (5) can be a bearing, which allows the rotation of the side roller (4), i.e., the side roller is mounted in a corresponding bearing, i.e., a sliding, a ball or a roller bearing.

The rocker arm 5 is held at its first end 5*a* to a supporting member and fixed at its second end 5*b* pivotable and releasable in relation to the position of the upper roller, as described below and with reference to FIG. 2. In the shown embodiment, the suspension point of the side roller (4) is geometrically placed between the first and second end of the rocker arm (5).At its first end (5*a*), the rocker arm is held by a supporting member (6), wherein the holder allows the rocker arm to rotate relative to the supporting member (6). Such a holder can be achieved in an exemplary embodiment by means of a connecting bolt, wherein the bolt acts as the axis of rotation. The bolt can be used to transmit large forces during a rolling process from the side roller (4), over the rocker arm (5) to the supporting member (6). At its second end (5*b*), the rocker arm is releasably fixed to the bending machine (1), wherein the positioning allows the rocker arm (5) to rotate around the positioning point at its second end (5*b*). Such a positioning of the rocker arm (5) can be achieved in an exemplary embodiment by using a combination of bores and bolts, wherein a (working) bolt (7) is guided through a bore in the rocker arm, and a bore in (a housing part of) the bending machine (1), so that the cotter bolt fixes the position of the rocker arm (5) relative to the upper roller and the lower roller, so that the rocker arm (5) can simultaneously rotate around this attachment point, but can still be easily released, so that the connection between the rocker arm (5) and the girder of the bending machine can be released by pulling out the (working) bolt (7). Particularly, the bolt (7) can easily be released if the side roller (4) does not apply any force to the bolt.

The supporting member (6) supports the rocker arm (5) at its first ending. In this embodiment, the supporting member (6) is rotatably attached to the rocker arm (5) and at its other end is also pivotably mounted, for example, with a bolt connection, wherein the bolt simultaneously forms the axis of rotation. The supporting member is designed to be movable in its length so that the supporting member (6) can rotate or pivot the rocker arm (5) around the (working) bolt to the second end of the rocker. In one embodiment, the supporting member can be a hydraulic cylinder or similar, for example, a threaded rod, so that the position of the rocker arm (5) can be adjusted with the supporting member (6). In this way, the position of the rocker arm (5) and therefore the position of the side roller (4), held by the rocker arm (5), can be pivoted in such a way that the position of the side roller (4) can be adjusted relative to the upper and lower rollers.

The geometrical arrangement of the rollers can be changed in this way, i.e., the side roller (4) can be moved closer to the upper and lower rollers (2, 3) so that a small bending radius can be set. Alternatively, the rocker arm (5) can be pivoted, so that the side roller is positioned further away from the upper and lower rollers to allow a larger bending radius.

Figure 2A:
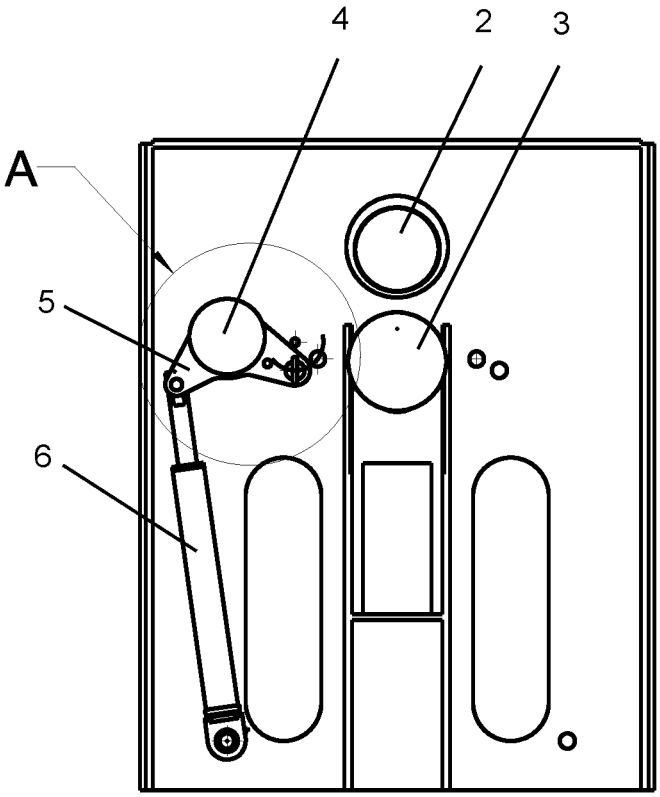
FIG. 2A-F show side views of the bending machine with different positions of a side roller.
Figure 2A:
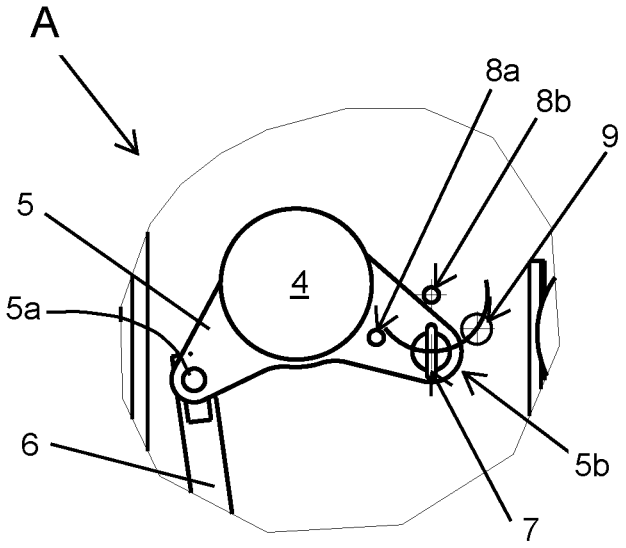

FIG. 2A shows a front view of the bending machine (1) with the upper and lower rollers (2, 3), and side roller (4) held by the rocker arm (5). The embodiment shown here comprises the three rollers mentioned above. In addition to the side roller (4), further embodiments may comprise one or more side or auxiliary rollers (not shown here).

The enlargement (A) in FIG. 2A shows the side roller (4) and the rocker arm (5), wherein the supporting member (6) is set in such a way that the rocker arm (5) is pivoted outwards as far as possible, i.e., the distance of the side roller (4) from the upper and lower roller (2, 3) is at its maximum with the position of the holder of the rocker arm (5). The first end (5*a*) of the rocker arm in this embodiment can be connected to the supporting member (6) with a bolt. The second end of the rocker arm (5) is fixed with a bolt in the girder of the bending machine (1), wherein the girder is the section of the bending machine which is intended to receive the bolt and therefore to receive the transmitted forces. The girder can, therefore, be an integral part of the bending machine (1), and alternatively, it can be a separate machine part.

The rocker arm (5) can be pivoted by adjusting the length of the supporting member (6), wherein the rocker arm rotates around the bolt (7) at the other end (5*b*). The bolt (7) is guided through a bore in the rocker arm (5) and engages in a girder of the bending machine (1), which absorbs the force transmitted by the bolt (7) and therefore carries the rocker arm (5), and the side roller (4).

The rocker arm (5) has a bore (8*a*) to receive an exchange bolt (10), not shown here, and the girder of the bending machine (1) has a corresponding bore (8*b*). These two bores are designed so that an exchange bolt is guided through bore (8*a*) into the bore (8*b*) to absorb the force of the rocker arm (5). The force to be absorbed is essentially the weight force, which is to be temporarily absorbed during the pivoting process described below, wherein during the pivoting process the bending machine is not operated in a productive sense. The exchange bolt (10) does not, therefore, have to absorb the forces that occur during the bending process, but only the weight forces, and can, therefore, be smaller scaled.

Furthermore, the girder of the bending machine, which absorbs the forces of the (working) bolt (7), and the exchange bolt, has a further bore (9) which is intended to receive the (working) bolt (7).

In the following, the pivoting of the rocker arm (5) is described, which means that the rocker arm (5) is finally held by the (working) bolt (7) in the bore (9).

Figure 2B:
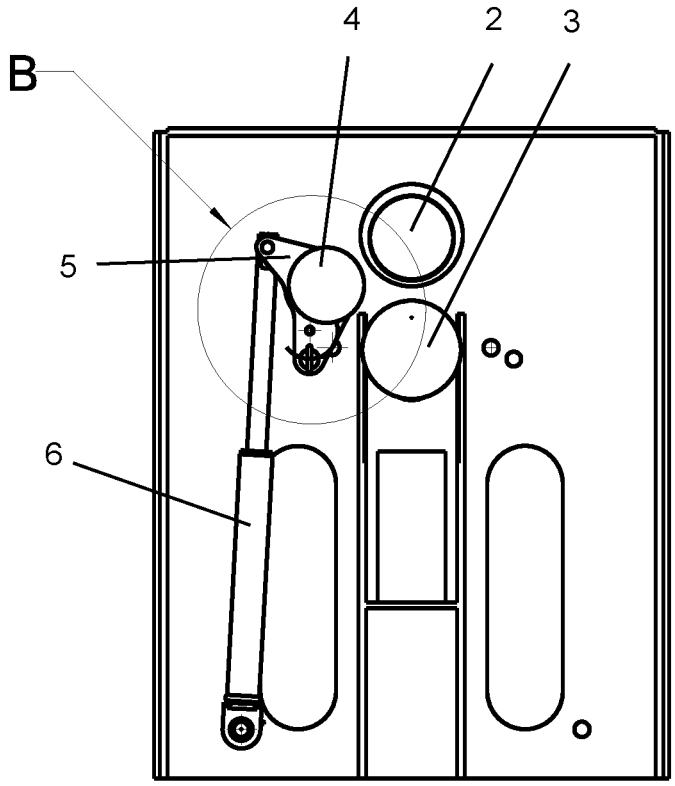
Figure 2B:
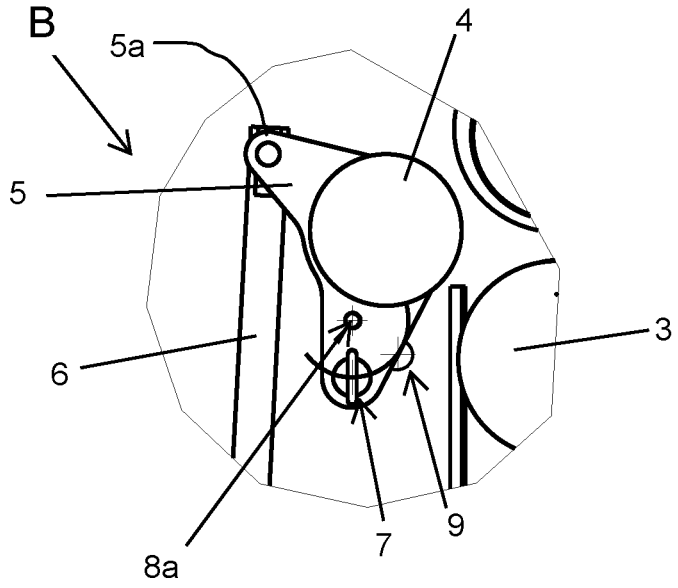

FIG. 2B and in particular cutout B show the position of the rocker arm (5) in which the rocker arm has, for example, been pivoted out of the position shown in FIG. 2A in such a way that the bore (8*a*) in the rocker arm (5) is congruent with the bore (8*b*). For this purpose the length of the supporting member was accordingly adjusted, i.e., in the present, the hydraulic cylinder was extended so far that the rocker arm (5) was rotated/pivoted around the bolt (7), that the bores (8*a*) and (8*b*) are congruent, so that an exchange bolt (10) can be placed inside.

Figure 2C:
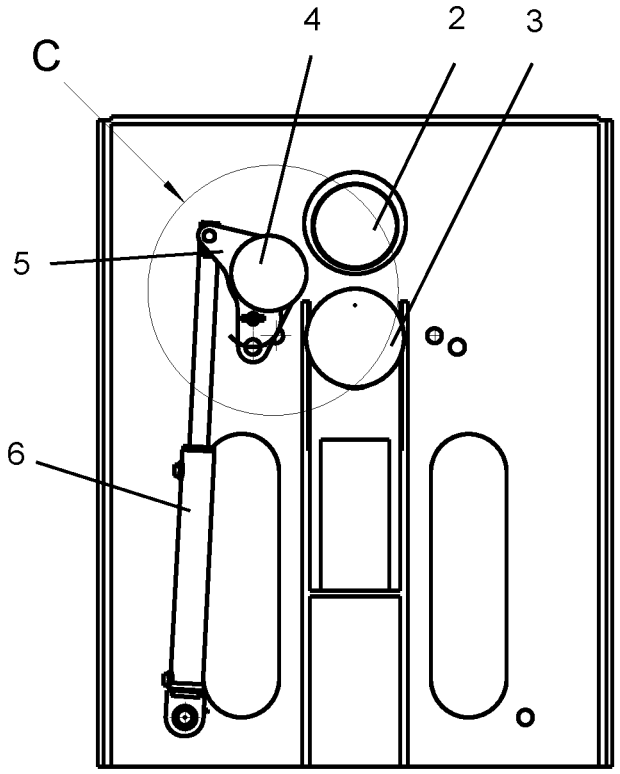
Figure 2C:
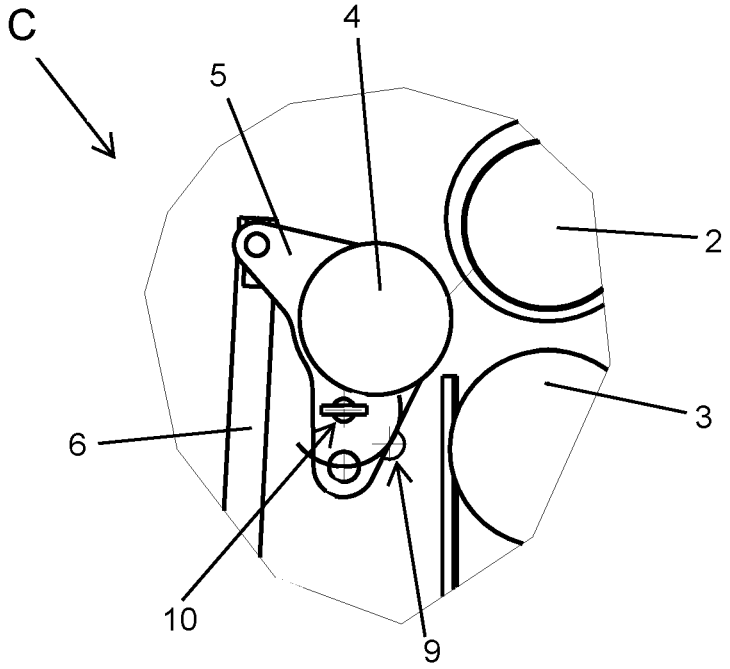

In the next pivoting step, see FIG. 2C, an exchange bolt (10) is positioned in the bores (8*a*, 8*b*), so that it connects the rocker arm (5) with the girder of the bending machine, and that the exchange bolt carries the rocker arm (5), and the side roller (4) held in it. In this way, the rocker arm (5) is pivoted from a first position to a second position, in relation to the upper and lower rollers (2, 3) of the bending machine, and is fixed there in a pivotable or rotatable second position.

As soon as the exchange bolt (10) has been placed, the bolt (7) can be removed, so that only the exchange bolt (10) bears the rocker arm (5), which can be rotatably or pivotably mounted. In an advantageous embodiment, the exchange bolt can be smaller, especially with a smaller diameter, since it only has to carry the weight of the rocker arm (5) together with the side roller (4) mounted in it.

Figure 2D:
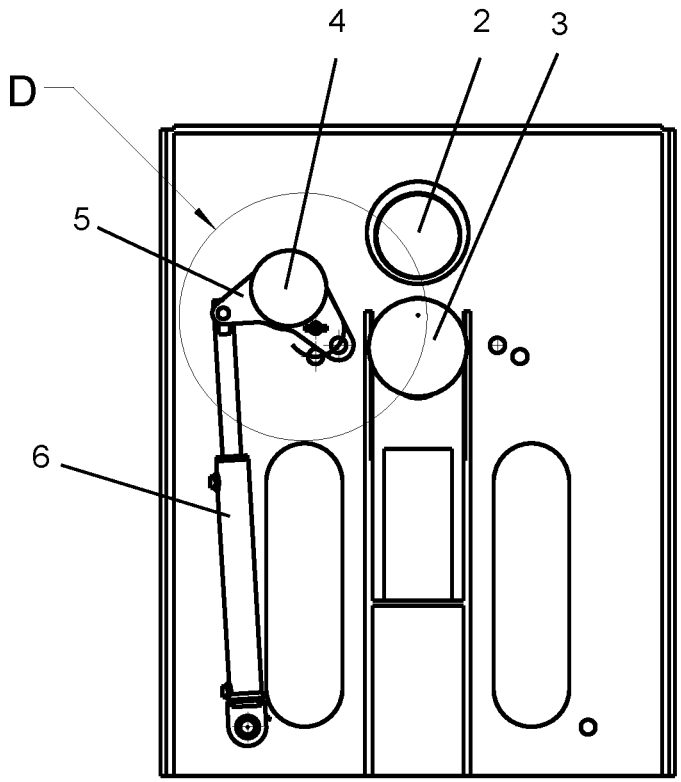
Figure 2D:
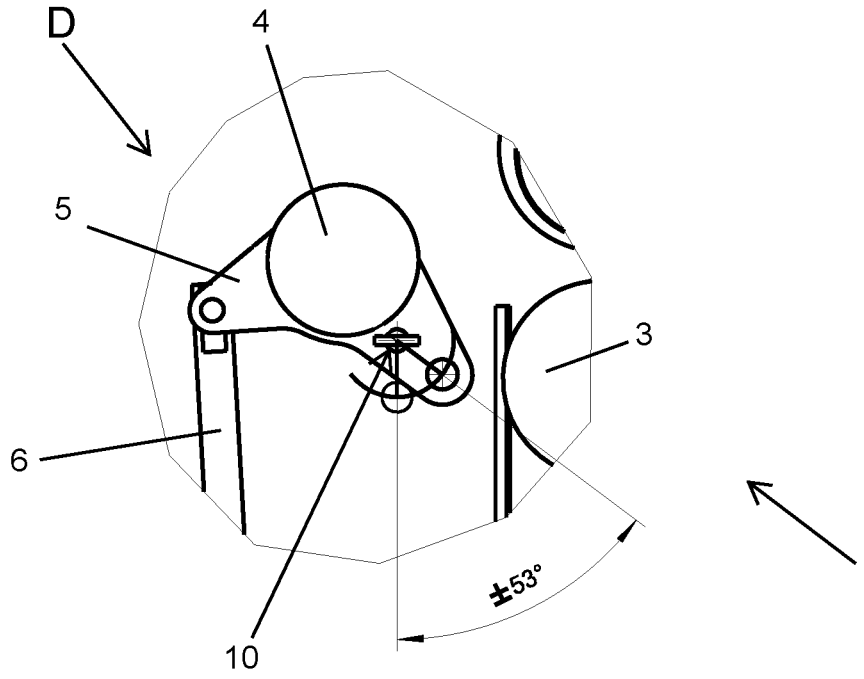

As shown in FIG. 2D, the position of the rocker arm (5) can now be changed by appropriately adjusting the supporting member (6), in particular, by pivoting it around the exchange bolt (10). In particular, the rocker arm (5) can be pivoted, here by shortening the supporting member (6) by approx. 53°, so that the bore in the rocker arm (5) for the bolt (7) is congruent with the bore (9) in the girder of the bending machine (1).

Figure 2E:
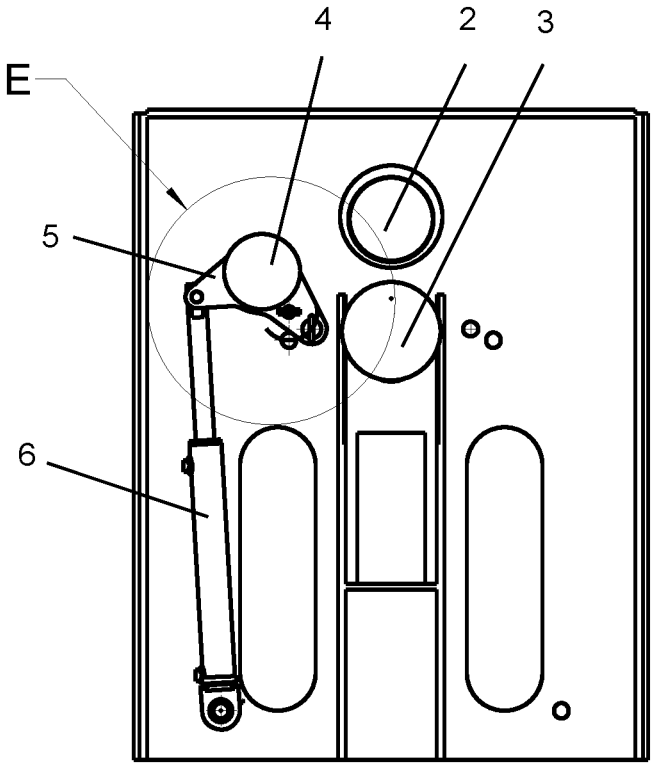
Figure 2E:
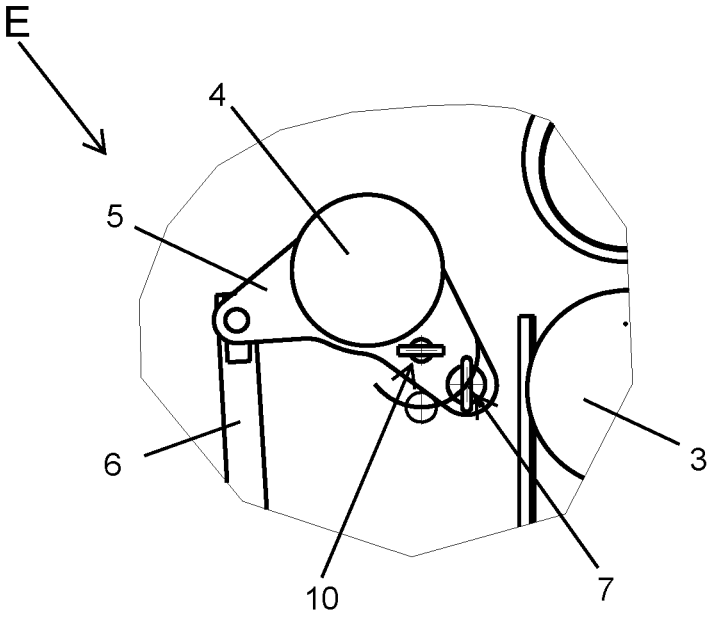

FIG. 2E shows the rocker arm (5) in the same position as in FIG. 2D, wherein the (working) bolt is placed in the rocker arm (5) and the bore (9), so that the bolt (7) carries the rocker arm (5) and the side roller (4). In the condition shown, both, the bolt (7) and the exchange bolt (10) are placed in the rocker arm and the girder of the bending machine (1), so that the rocker arm (5) is fixed by both bolts and therefore cannot be pivoted.

The exchange bolt (10) can be removed as soon as the bolt (7) is placed. Then the rocker arm (5) can be rotated or pivoted around the bolt (7). The rocker arm (5) is therefore pivoted from the second to a third position and can be rotated or pivoted.

In the case shown, the rocker arm (5) is located closer to the upper and lower rollers of the bending machine because the bore (9) in the girder is located closer to the upper and lower rollers of the bending machine.

Figure 2F:
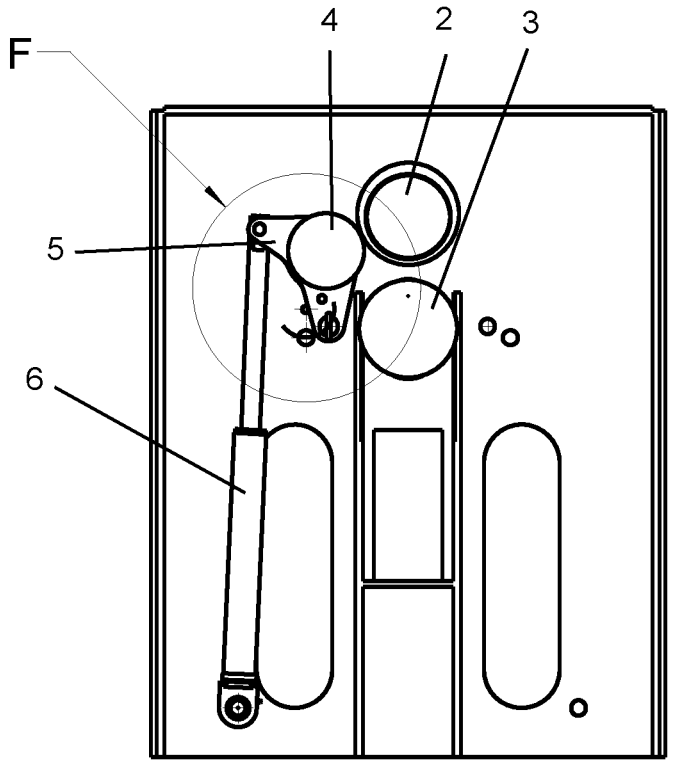
Figure 2F:
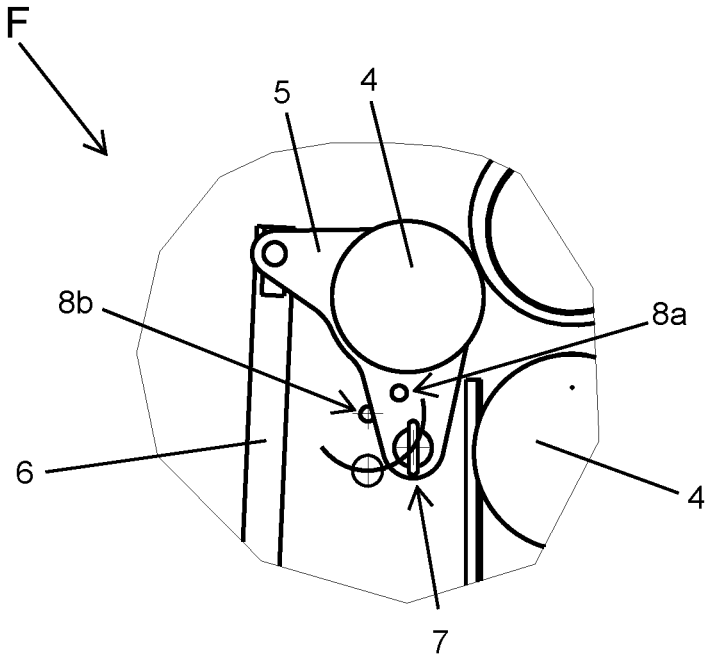

If the rocker arm (5) is now pivoted further by suitably adjusting the supporting member (6) when the (working) bolt (7) is placed in the bore (9), see FIG. 2F, the side roller (4) can be placed closer to the upper and lower rollers. In the position shown, the side roller (4) is located closer to the upper and lower rollers than in the position shown in FIG. 2A.

In this way, the position of the rocker arm (5) and the side roller (4) held in it can be changed, so that the arrangement of the side roller in relation to the upper and lower roller can be changed and adjusted according to the requirements. The force for pivoting and supporting the rocker arm (5) and the side roller (4) is applied via the supporting member (6) and the exchange bolt (10), so that during the pivoting of the side roller (4) it does not have to be held or lifted by means of a crane or similar. When pivoting, only the (working) bolt (7) and the exchange bolt (10) have to be placed at the respective end of the side roller, which can be done manually or at least with considerably less effort.

In this way, the rocker arm (5) is pivoted from the first position, see FIG. 2A, via a second (intermediate) position, see FIG. 2C, to a third position, see FIG. 2F, wherein the side roller (4) is positioned closer to the upper and lower roller in the third position. In a similar way, the side roller (4) can be pivoted from this position back to the second (intermediate) position, and then back to the first position in a further pivoting process. In addition, the side roller can be pivoted into one or more positions via an intermediate position, as long as corresponding bores (8*b*) for the exchange bolts and corresponding bores (9) for the (working) bolts are provided. In this way, the side roll can be pivoted into different positions, so that the geometry of the rollers can be adapted to the requirements. FIG. 2F shows an arrangement in which the side roller (4) is much closer to the upper and lower rollers (2, 3) than in the arrangement shown in FIG. 2A. Accordingly, a smaller bending radius can be achieved with the positioning of the side roller (4) shown in FIG. 2F, as this allows the upper roller with a smaller diameter to be installed, instead of the arrangement shown in FIG. 2A. On the other hand, the arrangement shown in FIG. 2A can be used to bend a sheet metal of greater thickness.

The figures show a design in which the side roller (4) can be arranged in two positions by means of the (working) bolt. In further designs, the girder of the bending machine can comprise further bores (8*b*, 9) to receive the exchange bolt as well as the (working) bolt (7), so that the rocker arm (5) can be pivoted into further positions.

In the designs described above, in order to change the geometrical arrangement of the side roller (4), the rocker arm is pivoted by means of the supporting member into an intermediate position, in which the rocker arm is held by means of an exchange bolt (10), and from there it is pivoted again by means of the supporting member into the second position, in which the rocker arm is then positioned again with the working bolt (7). In this way, the rocker arm (5) can be positioned in a first, or alternatively, in a second position. In further alternative embodiments, the rocker arm can be moved to the second position by other suitable means, so that it can be positioned there. In alternative embodiments, the rocker arm can also be lifted into the second position by means of a crane. Likewise, not only the girder of the bending machine but also the rocker arm itself can comprise more than one receiver for a working bolt with which the rocker arm can be positioned.

Figure 3:
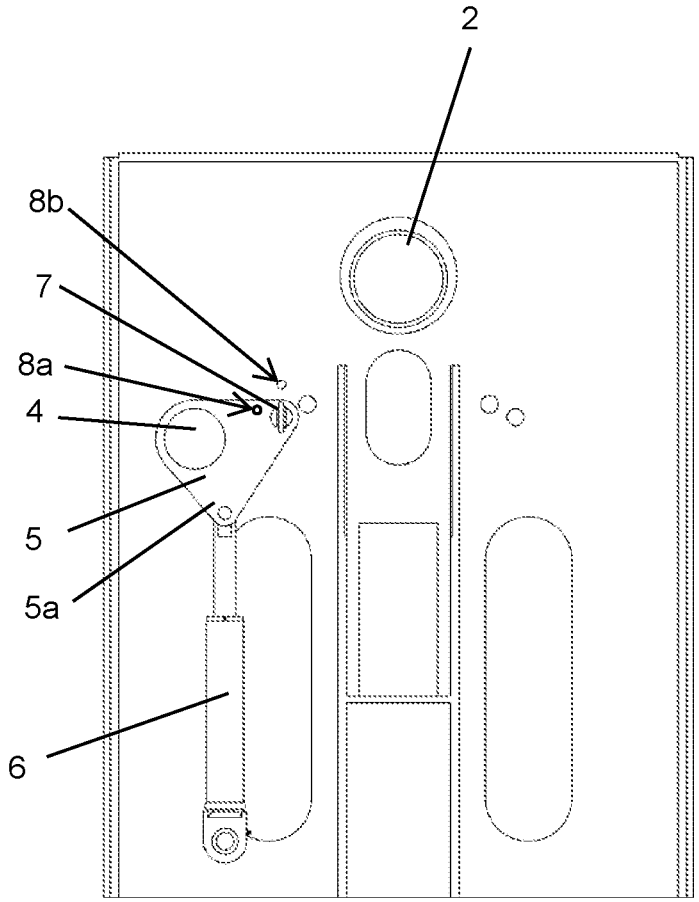
FIG. 3 shows a schematic view of an alternative design of the rocker arm.

FIG. 3 shows a schematic representation of an alternative design of the rocker arm (5), which is designed in a suitable way with other lever lengths. Thereby the representation shows a front view analogous to FIG. 2, wherein only an upper roller (2) and a side roller (4) are shown, but not a lower roller or a second side roller. As described above, the rocker arm (5) is supported at its one end with a working bolt (7) so that it can be pivoted and released, and has a bearing to receive a side roller (4). In contrast to the design shown in FIG. 1 and FIG. 2, the arrangement of the supporting member is chosen in such a way that other lever ratios are achieved, i.e., in such a way that a shorter pivoting of the supporting member (6) is required for a pivoting movement of the rocker arm (5), but with a greater force. This is achieved by placing the holder of the supporting member (6) closer to the working bolt (7). Although the supporting member must be designed accordingly for the application and absorption of larger forces, the supporting member only needs to be designed for shorter path lengths. Because the supporting member (6) in the shown embodiment always remains underneath the side roller (4), it is protected against damage by sheet metals which do not remain ideally in the bending path. This rocker arm also enables an overall more compact construction. Furthermore, the inlet height is reduced, so that the foundation on which the bending machine (1) is placed, is less complex to design.

Figure 4:
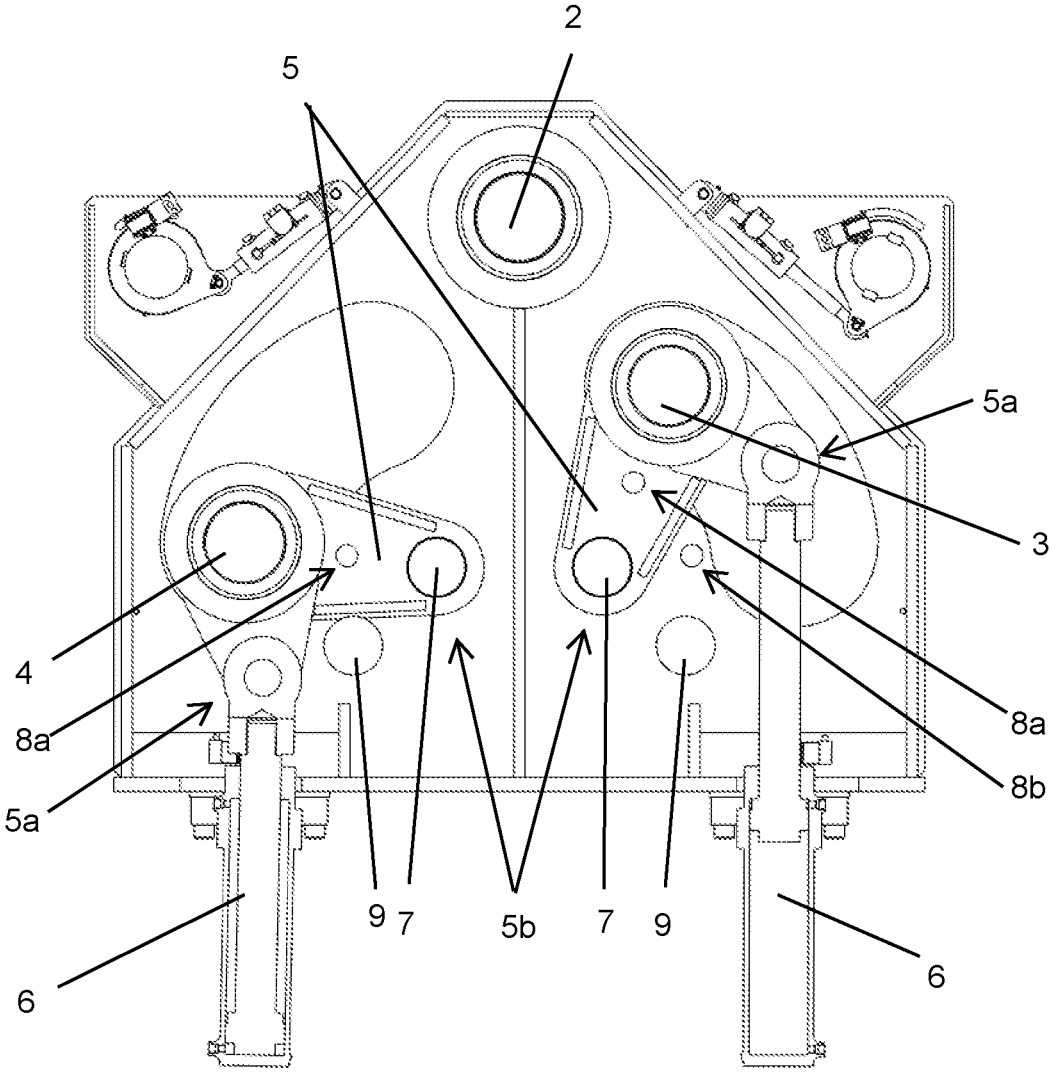
FIG. 4 shows a schematic view of a profile bending machine.

FIG. 4 shows a further design of a bending machine, in which the roller (4) is held in a rocker arm (5), and wherein one end of the rocker arm can be positioned in a relative position to the second position roller. FIG. 4 shows a schematic view of a profile bending machine. In contrast to the bending machine described in connection with FIGS. 1 to 3 in a profile bending machine, the bending rollers and bending waves are only held on one side. A tool can, therefore, be attached to the free end of such a roller or wave, which comprises the negative shape of the profile to be bent, so that the profile is held by the tool during the bending process, and is therefore not damaged during the bending process.

This bending machine (1) has an upper roller (2), which is positioned like the ones described before. Furthermore, the machine comprises two further rollers (3, 4), which are symmetrically arranged here and held in a respective rocker arm (5). One end (5*a*) of each rocker arm is fixed by a movable supporting member (6), which is shown in the figure as a hydraulic cylinder. With the other end (5*b*), the rocker arm (5) can be positioned in the first position and second position, wherein a rocker arm with the working bolt (7) is positioned in the first position, but can be released, i.e., fixed in the first bore. FIG. 4 shows a positioning of the rocker arms (5) in the first position. The rocker arms can be pivoted to a second position in the same way as mentioned before, related to FIG. 2, and positioned in the respective second position with the working bolt. For the pivoting process, each rocker arm (5) has a bore (8*a*), and the girder has corresponding bores (8*b*) into which an exchange bolt can be inserted so that one rocker can be rotated into the second position around the respective exchange bolt during the pivoting process. In the second position, the rocker arm can be positioned again with the working bolt (7). The girder of the profile bending machine has a corresponding bore (9) to receive the working bolt.

REFERENCE SIGN LIST

1 bending machine
2 upper roller
3 lower roller
4 side roller
5 rocker arm
5*a* first end of the rocker arm
5*b* second end of the rocker arm
6 supporting member
7 (working) bolt
8*a* bore in rocker arm (5) for exchange bolt (10)
8*b* bore in the girder for exchange bolt (10)
9 further bore for (working) bolt (7) in the girder of the bending machine
10 exchange bolt

We claim:

1. A bending machine for bending a sheet metal comprising:

an upper roller;

a further roller;

a side roller;

a rocker arm configured to hold the side roller;

a supporting member; and a frame having a suspension side, wherein:

the rocker arm has a first end and a second end;

the first end of the rocker arm is movably fixed to the supporting member, and the second end of the rocker arm is configured to be fixed to the frame having a suspension side, such that the side roller can be fixed in a plurality of positions in relation to the upper roller and the further roller;

the second end of the rocker arm comprises a first bore, the frame having a suspension side comprises a first corresponding bore, the first bore and the first corresponding bore are configured to receive a working bolt to fix the second end of the rocker arm to a first position of the frame having a suspension side during a bending operation of the bending machine, and the second end of the rocker arm comprises a second bore, the frame having a suspension side comprises a second corresponding bore, the second bore and the second corresponding bore are configured to receive an exchange bolt to fix the second end of the rocker arm to a second position of the frame having a suspension side to carry a weight force of the rocker arm during an exchange operation for pivoting the rocker arm from the second position to the first position when no bending operation is performed.

2. The bending machine according to claim 1, wherein the supporting member is configured to extend, retract, or rotate about an end of the supporting member to cause the rocker arm to pivot about the working bolt when the working bolt is inserted in the first bore and the corresponding first bore.

3. The bending machine according to claim 2, wherein the rocker arm can be pivoted from the second position into a third position.

4. The bending machine according to claim 3, wherein the rocker arm is pivotably mounted in the third position.

5. The bending machine according to claim 1, wherein the supporting member is configured to extend, retract, or pivot to cause the rocker arm to rotate about the exchange bolt when the exchange bolt is inserted in the second bore and the corresponding second bore.

6. The bending machine according to claim 1, wherein the rocker arm is a first rocker arm disposed at a first end of the side roller, and the bending machine includes a second rocker arm disposed at a second end of the side roller, and the side roller is held at both the first end and the second end in the first rocker arm and the second rocker arm.

7. A method for changing arrangement of a side roller of a bending machine according to claim 1, the method comprising:

moving the rocker arm to the second position; and inserting the exchange bolt into the second bore and the second corresponding bore to fix the rocker arm to the second position.

8. The method according to claim 7, further comprising:

adjusting the movable supporting member to pivot the rocker arm about the exchange bolt, aligning the first bore with the first corresponding bore;

inserting the working bolt into the first bore and the first corresponding bore to fix the rocker arm in the first position; and removing the exchange bolt from the second bore and the second corresponding bore.

9. The method according to claim 8, further comprising:

adjusting the movable supporting member to pivot the rocker arm about the working bolt, causing the rocker arm to move from the first position to a third position; and fixing the movable supporting member to secure the rocker arm in the third position.

10. The method according to claim 9, further comprising fixing the rocker arm in the third position with the exchange bolt.

* * * * *